US009324271B2

(12) United States Patent
Chang et al.

(10) Patent No.: US 9,324,271 B2
(45) Date of Patent: Apr. 26, 2016

(54) PIXEL DRIVER

(71) Applicant: AU Optronics Corporation, Hsin-Chu (TW)

(72) Inventors: Hua-Gang Chang, Hsin-Chu (TW); Li-Wei Liu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 345 days.

(21) Appl. No.: 14/132,438

(22) Filed: Dec. 18, 2013

(65) Prior Publication Data

US 2014/0368487 A1 Dec. 18, 2014

(30) Foreign Application Priority Data

Jun. 13, 2013 (TW) ..... 102120947 A

(51) Int. Cl.
*G09G 3/32* (2006.01)

(52) U.S. Cl.
CPC ..... *G09G 3/3266* (2013.01); *G09G 3/3225* (2013.01); *G09G 2300/0852* (2013.01); *G09G 2300/0866* (2013.01); *G09G 2310/0286* (2013.01); *G09G 2320/0233* (2013.01)

(58) Field of Classification Search
CPC ..... G09G 3/30; G09G 3/3208; G09G 3/3225; G09G 3/3233; G09G 3/3241; G09G 3/325; G09G 3/3266; G09G 3/3275; G09G 3/3258; G09G 3/3291; G09G 2300/043; G09G 2300/0852; G09G 2300/0866; G09G 2310/0264; G09G 2310/0286; G09G 2320/00; G09G 2320/0233
USPC ..... 345/76–83, 204, 211–212; 315/169.3
See application file for complete search history.

(56) References Cited

U.S. PATENT DOCUMENTS

| | | | | |
|---|---|---|---|---|
| 8,446,343 | B2 * | 5/2013 | Akimoto | G09G 3/3233 345/76 |
| 2003/0227262 | A1 | 12/2003 | Kwon | |
| 2005/0093464 | A1 * | 5/2005 | Shin | G09G 3/325 315/169.1 |
| 2005/0264493 | A1 | 12/2005 | Shin | |
| 2010/0013806 | A1 | 1/2010 | Yoo et al. | |
| 2010/0073267 | A1 * | 3/2010 | Akimoto | G09G 3/3233 345/76 |
| 2010/0194716 | A1 * | 8/2010 | Park | G09G 3/3233 345/204 |
| 2010/0295758 | A1 * | 11/2010 | Kawabe | G09G 3/3233 345/76 |
| 2011/0109599 | A1 | 5/2011 | Han | |
| 2014/0225878 | A1 * | 8/2014 | Shih | G09G 3/3258 345/205 |

FOREIGN PATENT DOCUMENTS

| | | |
|---|---|---|
| CN | 1490779 | 4/2004 |
| CN | 1684132 A | 10/2005 |
| CN | 1705004 | 12/2005 |
| CN | 103035201 | 4/2013 |

* cited by examiner

*Primary Examiner* — Rodney Amadiz
(74) *Attorney, Agent, or Firm* — WPAT, P.C.; Justin King

(57) ABSTRACT

A pixel driver includes an input unit, a power-switching unit, a voltage-dividing unit, a pixel-driving unit and a shorting unit. The input unit outputs a data voltage according to a first scan signal and a data signal. The power-switching unit outputs a first power voltage according to a first power voltage and a power-controlling signal. The voltage-dividing unit adjusts a control voltage according to a second scan signal. The pixel-driving unit includes a control terminal, a first terminal and a second terminal. The pixel-driving unit provides a driving current to an LED according to the voltage difference between the control terminal and the second terminal. The shorting unit connects the control terminal to the first terminal according to the first scan signal.

20 Claims, 9 Drawing Sheets

522

PIXEL DRIVER

RELATED APPLICATIONS

This application claims priority to Taiwan Application Serial Number 102120947, filed Jun. 13, 2013, which is herein incorporated by reference.

BACKGROUND

1. Field of Disclosure

The present disclosure relates to a display panel. More particularly, the present disclosure relates to a display panel with pixel drivers.

2. Description of Related Art

With the vigorous development of display technology, flat panel displays have been widely applied in daily life. In the flat panel displays, active Matrix Organic Light-Emitting Diode (AMOLED) display is very popular for its performances of high image quality, high contrast, and high reaction speed.

FIG. 1 is a schematic diagram of a conventional pixel-driving circuit. Power voltages OVDD and OVSS are applied to a pixel-driving circuit 10 for providing a driving current passing through the pixel-driving circuit 10. A scan signal SCAN is utilized to drive the pixel-driving circuit 10 according to a data voltage Data. The pixel-driving circuit 10 is a conventional structure with only two transistors and only one capacitor (known as 2T1C structure). To be more specific, a gate terminal of one transistor is directly connected with the scan line (marked as SCAN in FIG. 1) and a drain terminal of one transistor is directly connected with the data line (marked as Data in FIG. 1). On the other hand, a gate terminal of the other transistor is directly connected with the source terminal of the first transistor and an electrical terminal of the capacitor. A drain terminal of the other transistor is directly connected with the power line (marked as OVDD in FIG. 1) and the other electrical terminal of the capacitor. A source terminal of the other transistor is directly connected with an electrical terminal of the LED. The other electrical terminal of the LED is directly connected with the ground wire (marked as OVSS in FIG. 1). However, the operational characteristics of different pixels within the same panel will not be identical due to the variations in manufacturing process. Therefore, when identical data voltages Data are provided to the pixels, driving currents of different pixels may still be inconsistent, and it causes non-uniform brightness on the AMOLED display panel. In addition, voltage drop characteristics (known as IR drop) related to different pixels can be inconsistent. The inconsistent voltage drops of different pixels cause the non-uniform brightness on different areas over the AMOLED display panel as well as impact the image quality.

In order to solve aforesaid problems, such as the non-uniform brightness on the display panel induced by the inconsistent threshold voltages of the driving transistors of the pixels, a conventional driving circuit requires individual control circuits (including scan-driving circuits and timing controllers) for generating individual scan signals, individual light-emitting signals and individual resetting signals, which are suitable for those driving transistors with inconsistent threshold voltages. In the conventional solution, individual shift registers, buffers, power sources and clock signal wirings are required to generate those signals, such that large layout space will be occupied by these additional components and it is against a goal to narrow down a frame-width on a display panel.

Therefore, it is one of the most important topics to balance the brightness of pixels over the display panel and reduce the area required for the entire circuit layout.

SUMMARY

In order to solve the problems mentioned above, the disclosure provides a pixel driver, which is configured for driving an LED. The pixel driver includes input unit, a power-switching unit, a voltage-dividing unit, a pixel-driving unit, and a shorting unit. The input unit is configured for outputting a data voltage according to a first scan signal and a data signal. The power-switching unit is configured for outputting the first power voltage according to a first power voltage and a power-controlling signal. The voltage-dividing unit is configured for adjusting a control voltage according to a second scan signal. The pixel-driving unit includes a control terminal, a first terminal, and a second terminal. The pixel-driving unit is configured for providing a driving current to the LED according to the voltage difference between the control terminal and the second terminal. The shorting unit is configured for connecting the control terminal and the first terminal according to the first scan signal.

One embodiment of the present disclosure provides a display panel, which includes a plurality of pixels and a plurality of shift registers. Each of the pixels includes a LED and the aforementioned pixel driver, and a corresponding one of the shift registers is configured for generating the first scan signal.

Another embodiment of the present disclosure provides a driving method of pixel drivers, which includes the following steps: providing the aforementioned pixel driver; during a resetting period, the shorting unit connecting the control terminal and the first terminal according to the first scan signal so as to reset the control voltage with the first power voltage; during a charging period after the resetting period, the power switch unit stopping outputting the first power voltage, and the shorting unit connecting the control terminal and the first terminal according to the first scan signal, such that the pixel-driving unit performing voltage compensation; and during a light-emitting period after the charging period, the power switch unit outputting the first power voltage according to the first power voltage and the power controlling signal, and the voltage-dividing unit adjusting the control voltage according to the second scan signal, such that the pixel-driving unit providing a driving current to the LED according to the voltage difference between the control terminal and the second terminal.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
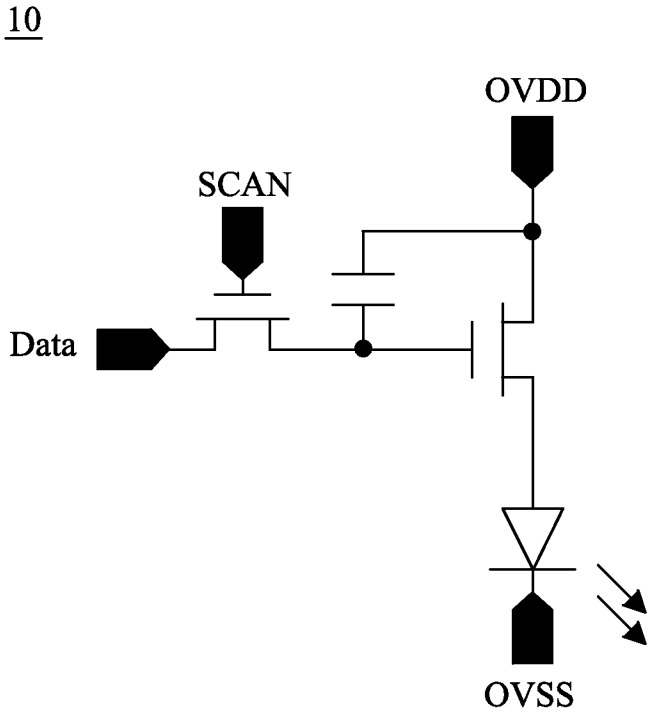
Fig. 1 ( PRIOR ART )
FIG. 1 is a schematic diagram of ordinary pixel-driving circuits.

Reference will now be made in detail to the present embodiments of the disclosure, examples of which are illustrated in the accompanying drawings. Wherever possible, the same reference numbers are used in the drawings and the description to refer to the same or like parts.

Figure 2A:
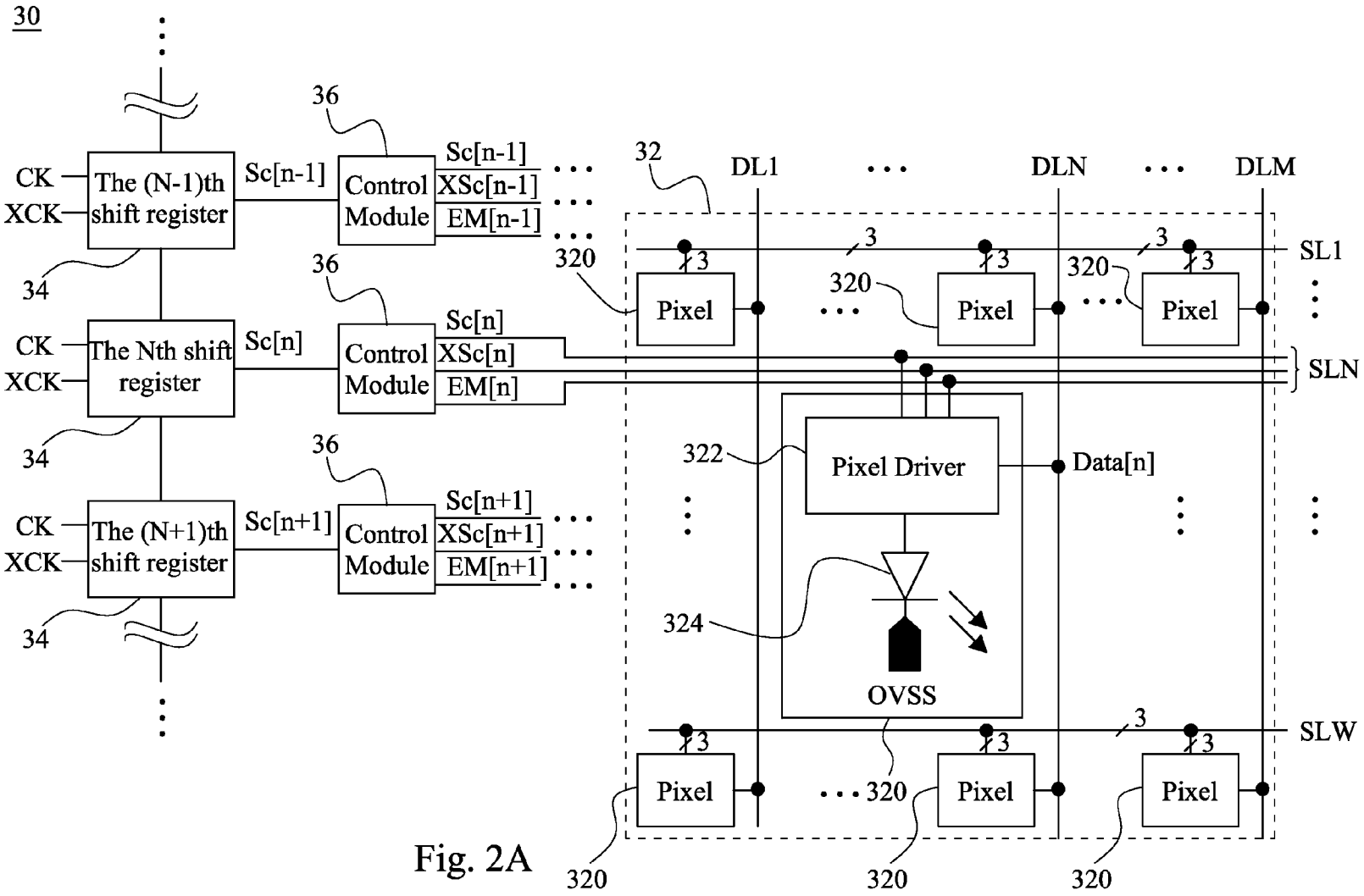
FIG. 2A is a schematic diagram of the display panel in accordance with one embodiment of the present disclosure.
Figure 2B:
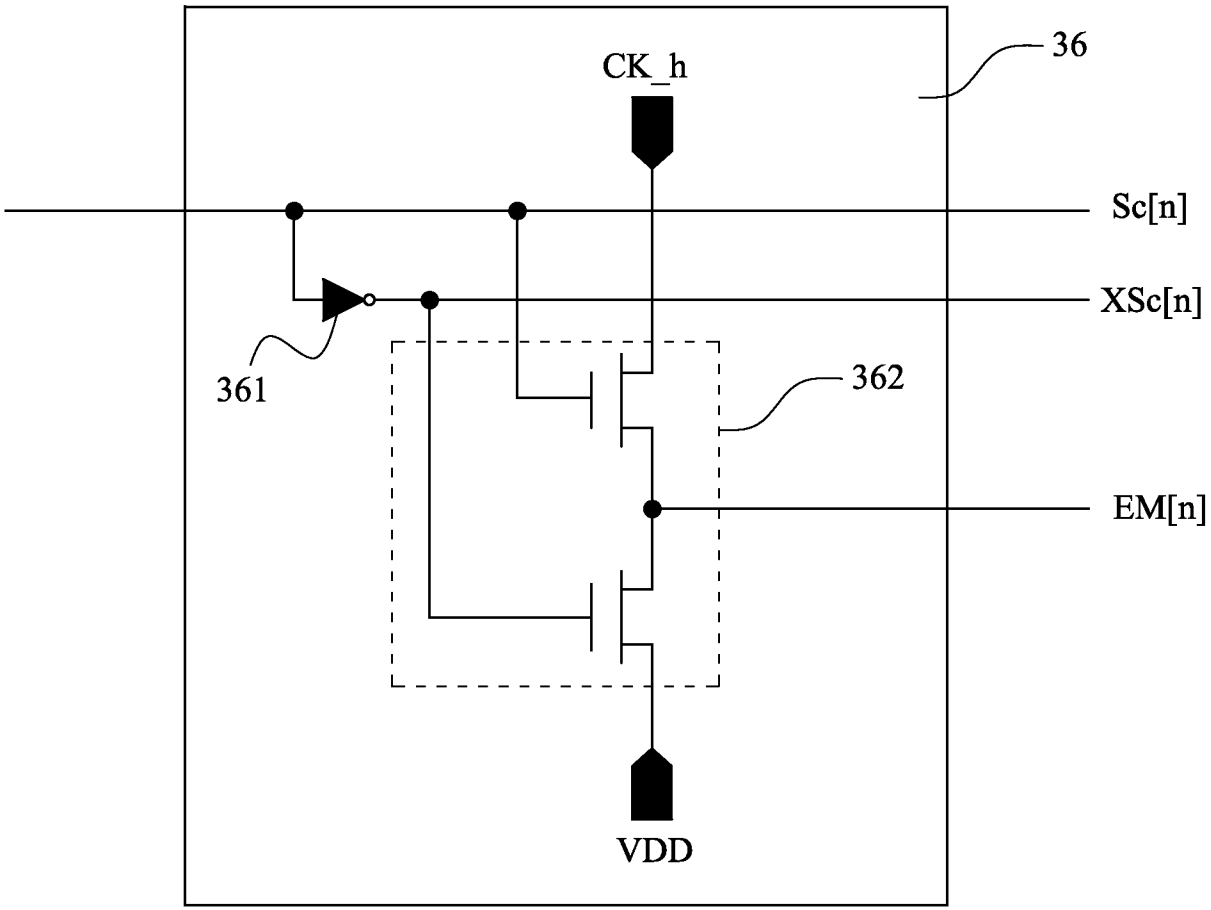
FIG. 2B is a schematic diagram of the circuit of the control module in the display panel illustrated in FIG. 2A.
Figure 2C:
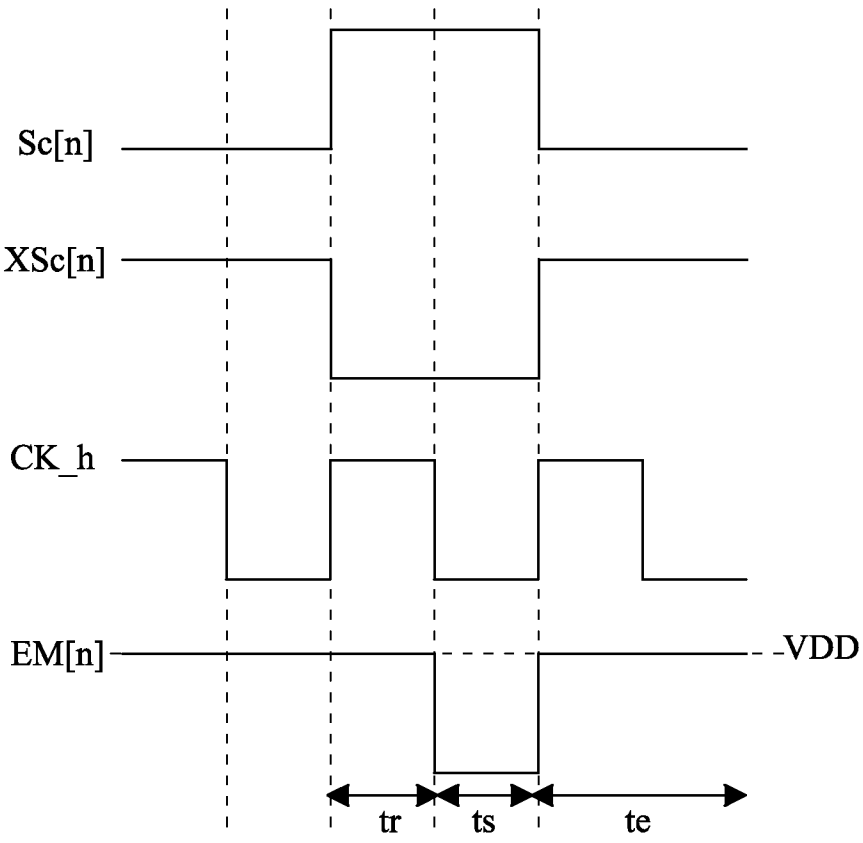
FIG. 2C is a schematic diagram of the timings of the operation signals in the control module illustrated in FIG. 2B.

FIG. 2A is a schematic diagram of the display panel 30 in accordance with one embodiment of the present disclosure. FIG. 2B is a schematic diagram of the circuit of the control module 36 in the display panel 30 illustrated in FIG. 2A. FIG. 2C is a schematic diagram of the timings of the operation signals in the control module 36 illustrated in FIG. 2B.

As illustrated in FIG. 2A, the display panel 30 includes multiple data lines DL1-DLM, multiple scan lines SL1-SLW, multiple pixels 320, and multiple cascaded shift registers 34. The multiple pixels 320 constitute a display matrix 32, wherein every pixel 320 is electrically connected to a corresponding data line (one of the data lines DL1-DLM) and a corresponding scan line (one of the scan lines SL1-SLW). Every pixel 320 includes a pixel driver 322 and a LED 324. The shift registers 34 provide scan signals for corresponding scan lines, wherein two of the input terminals of every shift register receive clock signals CK and XCK respectively, and the phase of the waveform of the clock signal XCK and the phase of the waveform of the clock signal CK are reverse.

Regarding to the shift register 34 disposed on the nth line, the shift register 34 provides a scan signal Sc[n] for the corresponding scan line SLN. In this embodiment, the display panel 30 further includes control modules 36, which are coupled between the shift register 34 of every line and a corresponding group of scan lines. Taking the nth line for example, the control module 36 is configured for generating another reverse scan signal XSc[n] and the power controlling signal EM[n] according to the scan signal Sc[n] provided by the shift register 34, and transmitting the scan signal Sc[n], the scan signal XSc[n] and the power controlling signal EM[n] together to the corresponding scan line SLN (where in this example, every group of scan lines SLN could include three physical lines).

The pixel driver 322 is electrically connected to the data line DLN and the scan line SLN. The data line DLN and the scan line SLN provide the data signal Data[n] and the scan signal Sc[n] for the pixel driver 322 respectively. The pixel driver 322 is configured for driving the LED 324 according to the data signal Data[n] and the scan signal Sc[n].

As the embodiment illustrated in FIG. 2B, the control module 36 could include an inverter 361 and a power-controlling signal generator 362. The inverter 361 is configured for generating the reverse scan signal XSc[n] according to the scan signal Sc[n]. The power-controlling signal generator 362 generates the power-controlling signal EM[n] according to the two scan signal Sc[n] and XSc[n] and the clock signal CK_h. Please refer to FIG. 2C for the relative relationships of the scan signals Sc[n], XSc[n], the clock signal CK_h, and the power-controlling signal EM[n].

In the display panel illustrated in this embodiment, the two scan signals received by the pixel driver 322 should have synchronous waveforms and reverse phases. In implementations, the scan signal XSc[n] could be provided by the inverter 361 of the control module 36 in FIG. 2B, and the inverter 361 could be realized by the cascade of a p-type transistor and a n-type transistor, but it is not limited herein.

It has to be explained here that the scan signal Sc[n] may have to pass through a butter when it is outputted from the Nth shift register 34 (not depicted,) and the buffer could be a cascade of multiple inverters in practical implementations, where the inverter 361 could be realized by one of the inverters in the buffer outputting the scan signal Sc[n] and hence it is not needed to dispose an additional inverter in the control module 36 to produce the scan signal XSc[n].

As illustrated in FIG. 2B, in one embodiment, the power-controlling signal generator 362 includes two switch units 363 and 364. The switch unit 363 conducts the clock signal CK_h to adjust the power controlling signal EM[n] according to scan signal SC[n]. The switch unit 364 is configured for conducting the constant voltage VDD to adjust the power-controlling signal EM[n] according to the scan signal XSc[n]. The two switch units 363 and 364 are electrically connected, and the node connecting them outputs the power-controlling signal EM[n].

For operations, please refer to FIG. 2B and FIG. 2C. As illustrated in FIG. 2B, the scan signal Sc[n] keeps a high level, while the scan signal XSc[n] keeps a low level, therefore the switch unit 363 is on and the switch unit 364 is off during the resetting period tr and the charging period ts. Hence, during the resetting period tr and the charging period ts, the switch unit 363 conducts and transmits the clock signal CK_h such that the waveform of the power-controlling signal EM[n] and the waveform of the clock signal CK_h are the same during the resetting period tr and the charging period ts. However, during the light-emitting period te, Sc[n] switches to a low level, while XSc[n] switches to a high level, therefore, the switch unit 363 is off and the switch unit 364 is on during the light-emitting period te. Hence, during the light-emitting period te, the switch unit 364 conducts and transmits constant voltage VDD such that the waveform level of the power-controlling signal EM[n] is constant during the light-emitting period te.

Figure 3:
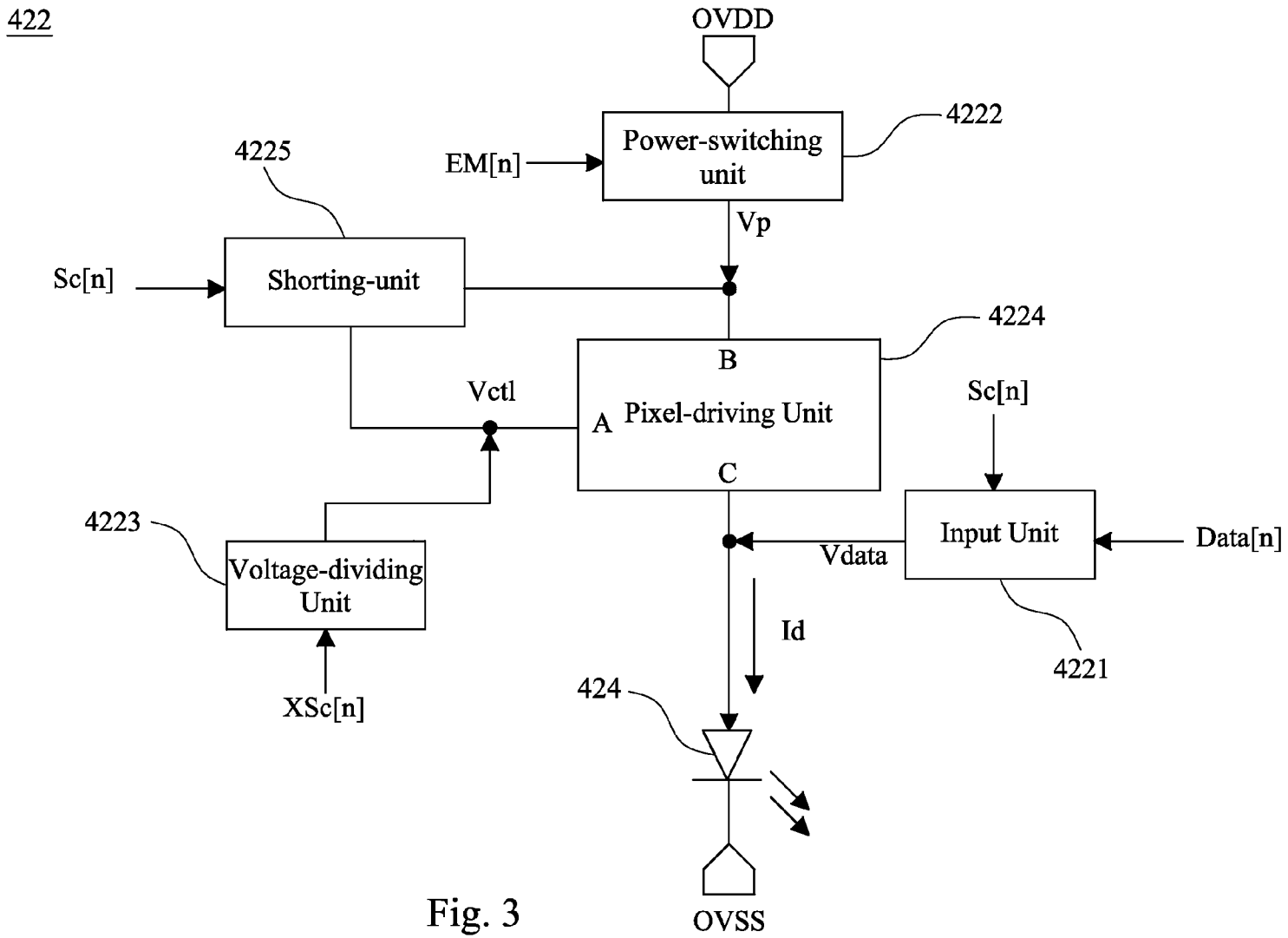
FIG. 3 is a schematic diagram of the circuit of the pixel driver in accordance with one embodiment of the present disclosure.

FIG. 3 is a schematic diagram of the circuit of the pixel driver 422 in accordance with one embodiment of the present disclosure, wherein the pixel driver 422 could be applied in the pixel driver 322 of FIG. 2A, or used as the drivers of other similar light-emitting elements. The pixel driver 422 is configured for driving the LED 424. The pixel driver 422 includes an input unit 4221, a power switch unit 4222, a voltage-dividing unit 4223, a pixel-driving unit 4224, and a shorting unit 4225.

The input unit 4221 outputs a data voltage Vdata according to the scan signal Sc[n] and the data signal Data[n]. The powers switch unit 4222 is configured for outputting a power voltage Vp according to the power voltage OVDD and the power-controlling signal EM[n]. The voltage-dividing unit 4223 is configured for adjusting a control voltage Vct1 according to the scan signal XSc[n]. The pixel driving unit 4224 includes a terminal A, a first terminal B, and a second terminal C. The pixel driving unit 4224 is configured for providing a driving current Id for the LED 424 according to the voltage difference between the control terminal A and the second terminal C. The first terminal B is configured for receiving the power voltage Vp. The second terminal C connected with the LED 424 is configured for receiving the data voltage Vdata[n] and outputting the driving current Id to the LED 424. The shorting unit 4225 is configured for connecting the control terminal A and the first terminal B according to the scan signal Sc[n]. For example, the first terminal B of the pixel-driving unit 4224 is connected with one terminal of the power switch unit 4222 and one terminal of the shorting unit 4225. The control terminal A of the pixel-driving unit 4224 is connected with another terminal of the shorting unit 4225 and one terminal of the voltage-dividing unit 4223. The second terminal C of the pixel-driving unit 4224 is connected with one terminal of the input unit 4221 and one electrode of the LED 424. Among which, the other two terminals of the power switch unit 4222 are connected with the power voltage OVDD and the power controlling signal EM[n] respectively, the third terminal of the shorting unit 4225 is connected with the scan signal Sc[n], the other terminal of the voltage-dividing unit is connected with the connection signal XSc[n], the other two terminals of the input unit 4221 are connected with the scan signal Sc[n] and the data signal Data[n] respectively, and the other electrode of the LED is connected with the power voltage OVSS, where the power voltage OVDD is different from the power voltage OVSS.

Moreover, the pixel-driving unit 4224 is further configured for adding the threshold voltage and the data voltage Vdata[n] and saving it in the control voltage Vct1 to be used in pixel-compensating operations. For example, the threshold voltage mentioned above is the threshold voltage of a transistor, which has a value of Vth, then the pixel-driving unit 4224 adds the threshold voltage Vth of the transistor and the data voltage Vdata[n] and save it in the control voltage Vct1 such that the level of the control voltage Vct1 is equal to (Vth+Vdata[n]).

For operations, in one embodiment, during the resetting period (for example, the resetting period tr illustrated in FIG. 4B,) the shorting unit 4225 connects the control terminal A and the first terminal B according to the scan signal Sc[n] to reset the control voltage Vct1 by using the power voltage Vp.

Figure 4A:
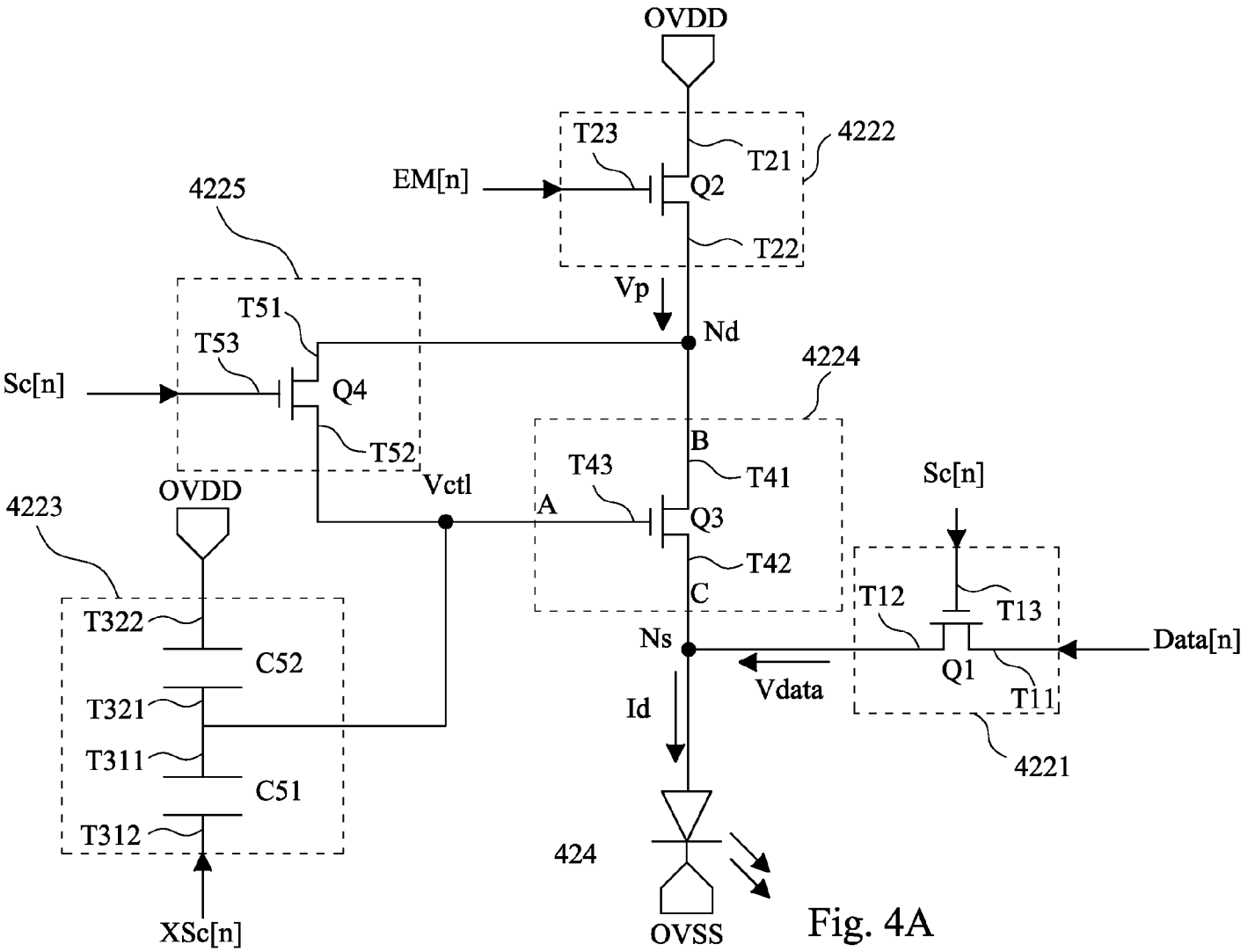
FIG. 4A is a schematic diagram of the circuit of the pixel driver in accordance with one embodiment of the present disclosure.
Figure 4B:
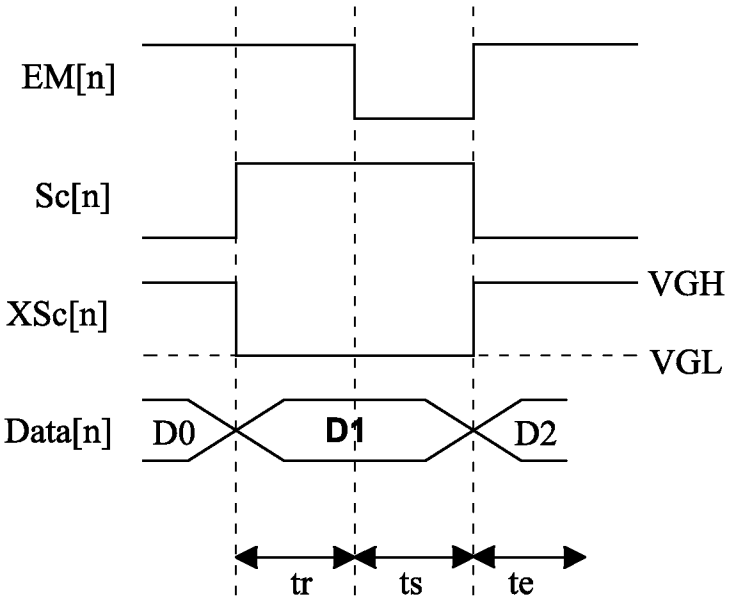
FIG. 4B is a schematic diagram of the timings of the operation signals in accordance with one embodiment of the present disclosure.

During the charging period after the resetting period mentioned above (for example, the charging period is illustrated in FIG. 4B,) the power switch unit 4222 stops outputting the power voltage Vp, the input unit 4221 outputs the data voltage Vdata[n] to the second terminal C, and the shorting unit 4225 connects the control terminal A and the first terminal B according to the scan signal Sc[n] such that the pixel-driving unit 4224 adds the threshold voltage (for example, the threshold voltage of a transistor) and the data voltage Vdata[n] and saves it in the control voltage Vct1 to be used in pixel-compensating operations.

During the light-emitting period after the charging period mentioned above (for example, the light-emitting period to illustrated in FIG. 4B,) the power switch unit 4222 outputs the power voltage Vp according to the power voltage OVDD and the power-controlling signal EM[n], and the voltage-dividing unit 4223 adjusts the control voltage Vct1 according to the scan signal XSc[n], such that the pixel-driving unit 4224 provides the driving current Id for the LED 424 according to the voltage difference between the terminal A and the second terminal C such that the LED 424 emits light during the light-emitting period mentioned above.

To explain the elements of the pixel driver specifically, take FIG. 4A for example, wherein FIG. 4A is a schematic diagram of the circuit of the pixel driver in accordance with one embodiment of the present disclosure, and the pixel driver 522 illustrated in FIG. 4A could be applied in the pixel driver 322 of FIG. 2A, but it is not limited herein. The pixel driver 522 could also be applied in the drivers of other similar light-emitting elements. Comparing with FIG. 3, the input unit 4221 includes a transistor Q1, and the transistor Q1 includes a gate terminal T13, a first terminal T11, and a second terminal T12. The gate terminal T13 is configured for receiving the scan signal Sc[n]. The first terminal T11 is configured for receiving the data signal Data[n]. The second terminal T12 is connected with the second terminal C of the pixel-driving unit 4224 at a node Ns to transmit the data voltage Vdata to the pixel-driving unit 4224 when the transistor Q1 is conducted.

As the embodiment illustrated in FIG. 4A, the power switch unit 4222 could include a transistor Q2, and the transistor Q2 includes a gate terminal T23, a first terminal T21, and a second terminal T22. The gate terminal T23 is configured for receiving the power-controlling signal EM[n]. The first terminal T21 is configured for receiving the power voltage OVDD. The second terminal T22 is connected with the first terminal B of the pixel-driving unit 4224 at a node Nd to transmit the power voltage Vp to the pixel-driving unit 4224 when the transistor Q2 is conducted.

As the embodiment illustrated in FIG. 4A, the shorting unit 4225 could include a transistor Q4, and the transistor Q4 includes a gate terminal T53, a first terminal T51, and a second terminal T52. The gate terminal T53 is configured for receiving the scan signal Sc[n]. The first terminal T51 is connected with the node Nd, i.e., the first terminal T51 is connected with the first terminal B of the pixel-driving unit 4224 and the second terminal T22 of the power-switching unit 4222, and the second terminal T52 and the control terminal A of the pixel-driving unit 4224 are both connected to the control voltage Vct1, i.e., a node, to connect the first terminal B of the pixel-driving unit 4224 and the control terminal A when the transistor Q4 is conducted.

As the embodiment illustrated in FIG. 4A, the pixel-driving unit 4224 could include a transistor Q3, and the transistor Q3 includes a gate terminal T43, a first terminal T41, and a second terminal T42. The gate terminal T43 is connected with the control terminal A of the pixel-driving unit 4224. The first terminal T41 is connected with the first terminal B of the pixel-driving unit 4224. The second terminal T42 is connected with the second terminal C of the pixel-driving unit 4224. In this embodiment, the LED 424 has two terminals (for example, two electrodes,) wherein one terminal (one electrode) is connected with the node Ns, i.e., one terminal receives the data voltage Vdata and is electrically connected with the transistor Q3, while the other terminal (the other electrode) receives the power voltage OVSS.

As the embodiment illustrated in FIG. 4A, the voltage-dividing unit 4223 could include a capacitor C51, and the capacitor C51 includes a first terminal T311 and a second terminal T312. The first terminal T311 is electrically connected with the control terminal A of the pixel-driving unit 4224, i.e., the first terminal T311 is connected to the control voltage Vct1 (node). The second terminal T312 is configured for receiving the scan signal XSc[n], such that the scan signal XSc[n] is coupled through the capacitor C51, and such that the voltage-dividing unit 4223 adjusts the control voltage Vct1 according to the scan signal XSc[n]. In another embodiment, the voltage-dividing unit 4223 further includes a capacitor C52. The capacitor C52 includes a first terminal T321 and a second terminal T322. The first terminal T321 of the capacitor C52 is connected with the first terminal T311 of the capacitor C51 and the first terminal T321 of the capacitor C52 and the first terminal T311 of the capacitor C51 are both connected to the control voltage Vct1 (node,) and the second terminal T322 is configured for receiving the power voltage OVDD.

To explain more explicitly the coupling of the scan signal XSc[n] through the capacitor C51, the scan signal XSc[n] is coupled to the control voltage Vct1 according to the capacitance ratio of the capacitor C51 and the capacitor C52, for example, the capacitor C51 has a capacitance Cap1, and the capacitor C52 has a capacitance Cap2, then when the scan signal XSc[n] switches from a low level VGL to a high level VGH, the voltage-dividing unit 4223 couple the level difference (VGH-VGL) of the scan signal XSc[n] to the level of the control voltage Vct1 with a ratio of $$\frac{Cap1}{Cap1 + Cap2}.$$

The followings explain the operations of the pixel driver illustrated in the present disclosure with FIG. 4A and FIG. 4B, wherein FIG. 4B is a schematic diagram of the timings of the operation signals in accordance with one embodiment of the present disclosure. In one embodiment, as illustrated in FIG. 4B, during the resetting period tr, a scan signal Sc[n] with a high level voltage is provided for the input unit 4221 and the shorting unit 4225, and a power-controlling signal EM[n] with a high level voltage is provided for the power-switching unit 4222, such that the shorting unit 4225 resets the control voltage Vct1 by using the power voltage Vp.

To be more specific, during the resetting period tr illustrated in FIG. 4B, the transistor Q1 conducts and resets the voltage level of the node Ns as Vdata, while the transistor Q4 conducts and connects the control voltage Vct1 and the node Nd, wherein the voltage level of the node Nd is the power voltage Vp, and the power voltage Vp is provided by conducting the transistor Q2 and transmitting the power voltage OVDD. The voltage difference between the data voltage Vdata and the power voltage OVSS is set to be smaller than the threshold voltage of the LED 424 (for example, the voltage difference between the data voltage Vdata and the power voltage OVSS is around −1 to 2.5 volts, while the threshold voltage of the LED 424 is 2.5 volts,) such that the LED 424 is not driven to emit light during the resetting period tr.

Then during the charging period is after the resetting period tr, the power-controlling signal EM[n] is switched from a high level voltage to a low level voltage to stop outputting the power voltage Vp such that the pixel-driving unit 4224 performs voltage compensation, and the scan signal XSc[n] with a voltage level of VGL is provided for the voltage-dividing unit 4223.

To be more specific, during the charging period ts illustrated in FIG. 4B, the transistor Q2 is turned off such that the voltage level of the node Nd and the voltage level of the control voltage Vct1 are not clamped at the power voltage Vp, and since the first terminal T41 and the gate terminal T43 of the transistor Q3 are connected (the node Nd and the control voltage Vct1 are connected,) the transistor Q3 is operated like a diode. Afterward, the transistor Q3 charges the voltage difference between the control voltage Vct1 and the node Ns to the threshold voltage, Vth, of the transistor Q3. Since the transistor Q1 is still on, the voltage level of the node Ns is clamped at the data voltage Vdata, such that the voltage level of the control voltage Vct1 is charged to the level (Vdata+Vth) to finish the pixel compensation operation. Moreover, the capacitor C51 and the capacitor C52 are charged according to the voltage level VGL of the scan signal XSc[n].

Then during the light-emitting period to after the charging period ts, the power-controlling signal EM[n] is switched from a low voltage level to a high voltage level to output the power voltage Vp, the scan signal Sc[n] is switched from a high voltage level to a low voltage to stop outputting the data voltage Vdata and disable the shorting operation of the shorting unit 4225, and the scan signal XSc[n] is switched from the voltage level VGL to the voltage level VGH to adjust the control voltage Vct1 and to drive the LED 424.

To be more specific, during the light-emitting period te illustrated in FIG. 4B, the transistor Q4 is turned off, such that the control voltage Vct1 is directly controlled by the voltage-dividing unit 4223 composed of the capacitor C51 and the capacitor C52. The capacitor C51 and the capacitor C52 are charged according to the voltage transition of the scan signal XSc[n] and the voltage level difference of the scan signal XSc[n] (VGH-VGL) is coupled to the voltage level of the control voltage Vct1, such that the voltage level of the control voltage Vct1 is lifted from the voltage level (Vdata+Vth) to the voltage level [Vdata+Vth+ax (VGH−VGL)], wherein a is the capacitance ratio:

$$a = \frac{Cap1}{Cap1 + Cap2},$$

unit: none.

During the light-emitting period te illustrated in FIG. 4B, since the transistor Q1 is turned off, the voltage of the node Ns is no longer clamped at the data voltage Vdata, such that the voltage level of the node Ns is adjusted to the voltage level (OVSS+Voled), wherein Voled is the voltage across the LED 424. Second, since the transistor Q2 conducts the power voltage OVDD and transmits the power voltage Vp, the transistor Q3 outputs the driving current Id according to the lifted control voltage Vct1 to drive the LED 424, wherein the driving current $Id=k[Vdata+a(VGH-VGL)-OVSS-Voled]^2$, the unit of Id is ampere (A), and k is the transistor constant, unit: none.

Figure 5:
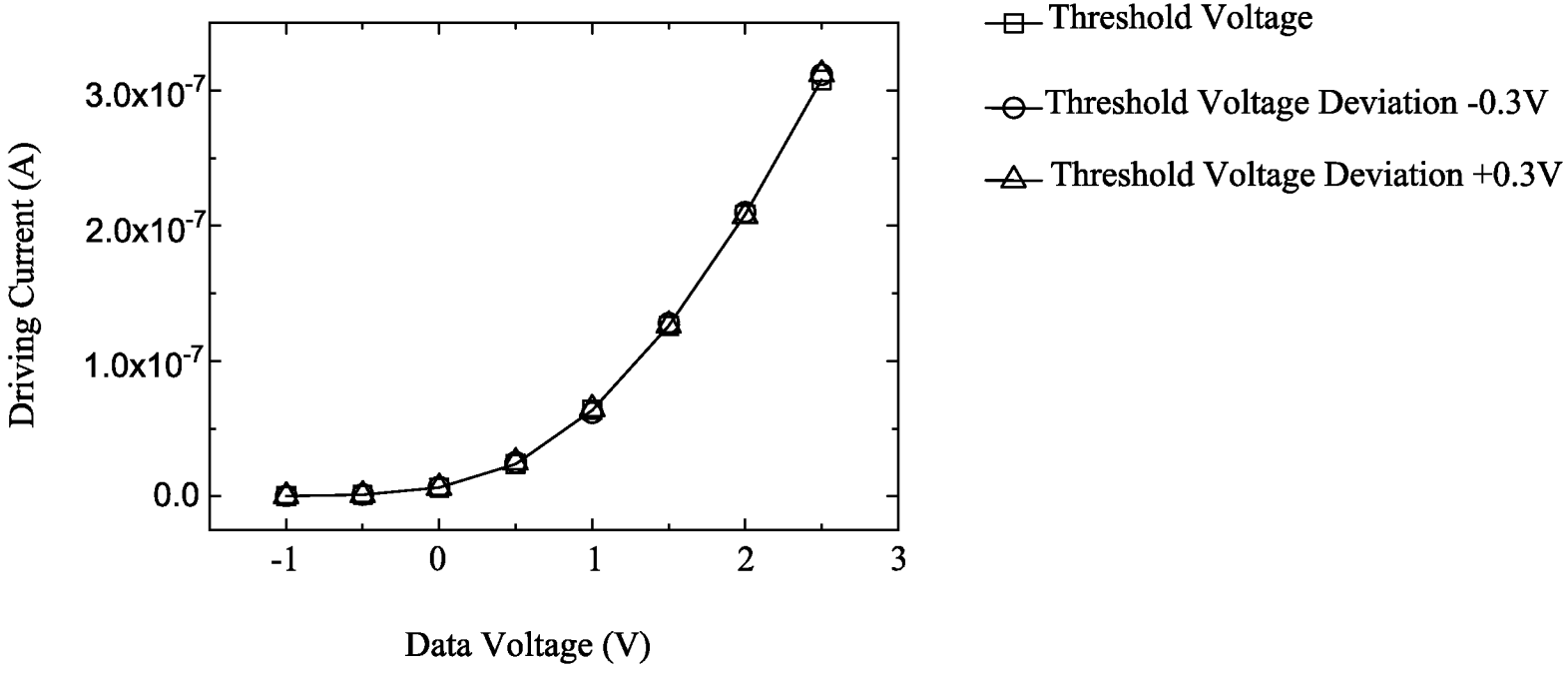
FIG. 5 is a schematic diagram of the curve of the driving current versus the data voltage illustrated in FIG. 4A.

From the above we know that the driving current provided by the pixel driver illustrated in the present disclosure is independent of the threshold voltage Vth of transistors, such that the situation that the driving currents are inconsistent could be avoided. As illustrated in FIG. 5, FIG. 5 is a schematic diagram of the curve of the driving current Id versus the data voltage Vdata illustrated in FIG. 4A. As illustrated in FIG. 5, the threshold voltage Vth varies within a positive deviation of around 0.3 volts and a negative deviation of around 0.3 volts, where the variation curves of driving currents coincide. In other words, the driving current Id is independent of the variation of the threshold voltage Vth.

Therefore, using the pixel driver illustrated in the present disclosure could avoid the inconsistence of driving currents induced by the difference between driving transistors, and could also avoid the inconsistence of driving currents induced by the difference between the voltage drops of power voltages, such that the non-uniform brightness on the display panel could be avoided.

The pixel driver 522 illustrated in FIG. 4A is composed of N-type transistors, but is not limited herein. In other words, the pixel driver illustrated in the present disclosure could also be composed of P-type transistors. The transistor types illustrated in the above diagram could include bottom gate transistors, top gate transistors, or other proper types, and the semiconductor materials forming the transistors could include oxide semiconductor materials, organic semiconductor materials, poly-silicon, amorphous silicon, single crystal silicon, micro crystal silicon, nanocrystalline silicon, and other proper materials. Take FIG. 6A for example, FIG. 6A is a schematic diagram of the pixel driver in accordance with another embodiment of the present disclosure. As illustrated in FIG. 6A, the pixel driver 722 includes transistors Qp1-Qp4 and capacitors C71 and C72, wherein the transistors Qp1-Qp4 are P-type transistors. The gate terminal of the transistor Qp1 is controlled by the scan signal Sc[k], another terminal of the transistor Qp1 receives the data signal Data[k], and the other terminal is connected with one terminal of the LED 724 at the node Ns. The gate terminal of the transistor Qp2 is controlled by the power-controlling signal EM[k], another terminal of the transistor Qp2 receives the power voltage OVSS, and the other terminal is connected with the node Nd. The gate terminal of the transistor Qp3 receives the control voltage Vct1, another terminal of the transistor Qp3 is connected with the node Ns, and the other terminal is connected with the node Nd. The gate terminal of the transistor Qp4 is controlled by the scan signal Sc[k], another terminal of the transistor Qp4 is electrically connected with the node Nd, and the other terminal is connected with the control voltage Vct1. One terminal of the capacitor C71 is controlled by the scan signal XSc[k] and the other terminal is electrically connected with the control voltage Vct1. One terminal of the capacitor C72 receives the power voltage OVSS and is connected with one terminal og the transistor Qp2, and the other terminal is connected with the control voltage Vct1. For example, the other terminal of the capacitor C72 is connected with the other terminal of the capacitor C71, the other terminal of the transistor Qp4, and the gate terminal of the transistor Qp3.

Figure 6B:
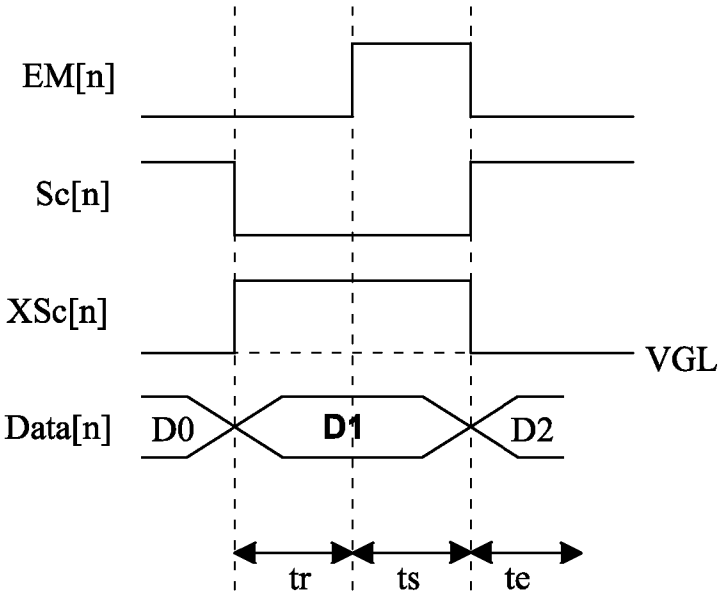
FIG. 6B is a schematic diagram of the timings of the operation signals in accordance with another embodiment of the present disclosure.
Figure 6A:
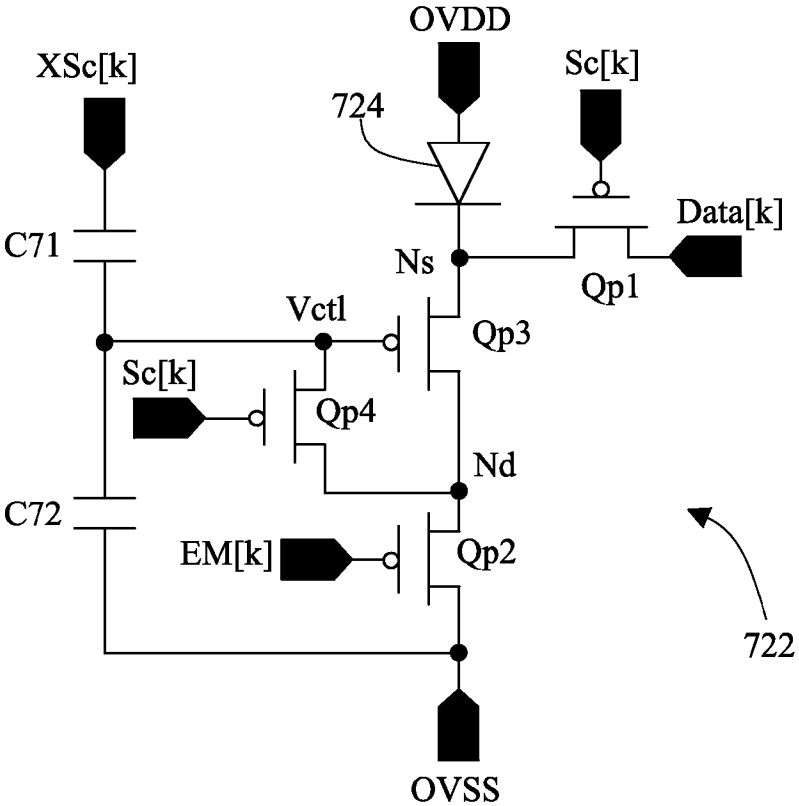
FIG. 6A is a schematic diagram of the pixel driver in accordance with another embodiment of the present disclosure.

The pixel driver 722 illustrated in FIG. 6A could be operated according to the operation signals illustrated in FIG. 6B, wherein FIG. 6B is a schematic diagram of the timings of the operation signals in accordance with another embodiment of the present disclosure. The operation of the pixel driver 722 illustrated in FIG. 6A is similar to the operations of the pixel driver 522 illustrated in FIG. 4A and is not explained again here. However, the control signal EM[n], the scan signal Sc[n], and the phase of the waveform of XSc[n] illustrated in FIG. 6B are opposite to the control signal EM[n], the scan signal Sc[n], and the phase of the waveform of XSc[n] illustrated in FIG. 4B.

From the above embodiments, as illustrated in FIG. 2A and FIG. 2B, a control module 36 is disposed between every shift register 34 and its corresponding scan line SL1-SLW. The control module could be realized by a simple inverter 361 and a power-controlling signal generator 362 (it could be realized by just two transistor switches). As the control module 36 imposed between the Nth shift register 34 and its corresponding scan line SLN illustrated in FIG. 2A, the inverter 361 can convert one of the scan signals to another scan signal, and the power-controlling signal generator 362 generates power-controlling signal EM[n] for all the pixel drivers 322 on the nth line. Therefore, it is not needed in this embodiment to impose another shift register, another buffer (for providing the reverse scan signal XSc[n]), and additional power and clock signal lines (for providing the power-controlling signal EM[n],) such that the space required for the entire circuit layout could be reduced, and the frame of the display panel which integrates the circuits could be designed in a narrower size.

We know from the above that using the pixel driver illustrated in the present disclosure could avoid the inconsistence of driving currents induced by the difference between driving transistors, and could also avoid the inconsistence of driving currents induced by the difference between the voltage drops of power voltages, such that the non-uniform brightness on the display panel could be avoided.

Another embodiment of the present disclosure is about the driving method of a pixel driver, wherein this driving method could be applied in the pixel driver 422 illustrated in FIG. 3 or the pixel driver 522 illustrated in FIG. 4A, but is not limited herein. The driving method will be explained as follows referring to FIG. 3. The driving method includes the following steps: providing a pixel driver 422, for example the one illustrated in FIG. 3; then in the resetting period (for example, the resetting period tr as illustrated in FIG. 4B,) conducts the power-switching unit to output the first power voltage to the first terminal, and the shorting unit 4225 connects the control terminal A and the first terminal B according to the scan signal Sc[n] to reset the control voltage Vct1 by using the power voltage Vp; then during the charging period after the resetting period mentioned above (for example, the charging period is illustrated in FIG. 4B,) the power switch unit 4222 stops outputting the power voltage Vp, the shorting unit 4225 connects the control terminal A and the first terminal B according to the scan signal Sc[n], and the input unit 4221 outputs the data voltage Vdata to the second terminal C according to the scan signal Sc[n], such that the pixel-driving unit 4224 performs the voltage compensation; then during the light-emitting period after the charging period mentioned above (for example, the light-emitting period to illustrated in FIG. 4B,) the power switch unit 4222 outputs the power voltage Vp according to the power voltage OVDD and the power-controlling signal EM[n], and the voltage-dividing unit 4223 adjusts the control voltage Vct1 according to the scan signal XSc[n], such that the pixel-driving unit 4224 provides the driving current Id for the LED 424 according to the voltage difference between the terminal A and the second terminal C.

In one embodiment, the voltage compensation operations operated by the pixel-driving unit 4224 further include the following steps: the pixel-driving unit 4224 adds the threshold voltage (for example, the threshold voltage of the transistor Q3 illustrated in FIG. 4A) and the data voltage Vdata and save it in the control voltage Vct1.

As illustrated in FIG. 4B, in one embodiment, the driving method during the resetting period tr further includes the following steps: first, a scan signal Sc[n] with a high level voltage is provided for the input unit 4221 and the shorting unit 4225; then a power-controlling signal EM[n] with a high level voltage is provided for the power-switching unit 4222, such that the shorting unit 4225 resets the control voltage Vct1 by using the power voltage Vp.

As illustrated in FIG. 4B, in one embodiment, the driving method during the charging period is further includes the following steps: first, the power-controlling signal EM[n] is switched from a high level voltage to a low level voltage to stop outputting the power voltage Vp such that the pixel-driving unit 4224 performs voltage compensation, and the scan signal XSc[n] with a voltage level of VGL is provided for the voltage-dividing unit 4223.

As illustrated in FIG. 4B, in one embodiment, the driving method during the light-emitting period to further includes the following steps: first, switch the power-controlling signal EM[n] from a low voltage level to a high voltage level to output the power voltage Vp; then switch the scan signal Sc[n] from a high voltage level to a low voltage to stop outputting the data voltage Vdata and disable the shorting operation of the shorting unit 4225; then the scan signal XSc[n] is switched from the voltage level VGL to the voltage level VGH to adjust the control voltage Vct1 and to drive the LED 424. The specific driving method of pixel drivers illustrated in the present disclosure could be operated as the embodiments illustrated in FIG. 4A and FIG. 4B, and is not explained again here.

We know from the above embodiments that using the driving method of pixel drivers illustrated in the present disclosure could avoid the inconsistence of driving currents induced by the difference between driving transistors by voltage compensation operations, and could also avoid the inconsistence of driving currents induced by the difference between the voltage drops of power voltages, such that the non-uniform brightness on the display panel could be avoided.

Above all, the advantage of using the pixel driver illustrated in the present disclosure is that the inconsistence of driving currents induced by the difference between driving transistors could be avoided, and the inconsistence of driving currents induced by the difference between the voltage drops of power voltages could also be avoided, such that the non-uniform brightness on the display panel could be avoided.

Second, the display panel illustrated in the present disclosure could generate one of the two scan signals by using a simple inverter, and it is not needed to impose another shift register, another buffer, and additional power and clock signal lines, such that the space required for the entire circuit layout could be reduced, and the frame of the display panel which integrates the circuits could be designed in a narrower size.

Moreover, the display panel illustrated in the present disclosure could generate the power-controlling signal by using two simple transistors, and it is not needed to impose another shift register, another buffer, and additional power and clock signal lines, such that the space required for the entire circuit layout could be reduced, and the frame of the display panel which integrates the circuits could be designed in a narrower size.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A pixel driver, applicable for driving a light-emitting diode (LED), the pixel driver comprising:

an input unit configured for outputting a data voltage according to a first scan signal and a data signal;

a power-switching unit configured for outputting the first power voltage according to a first power voltage and a power-controlling signal;

a voltage-dividing unit configured for adjusting a control voltage according to a second scan signal;

a pixel-driving unit comprising:

a first terminal;

a second terminal; and a control terminal configured for receiving the control voltage, the pixel-driving unit being configured for providing a driving current to the LED according to a voltage difference between the control terminal and the second terminal; and a shorting unit configured for connecting the control terminal and the first terminal according to the first scan signal.

2. The pixel driver of claim 1, wherein, during a resetting period, the shorting unit connects the control terminal and the first terminal according to the first scan signal so as to reset the control voltage with the first power voltage.

3. The pixel driver of claim 2, wherein, during a charging period after the resetting period, the power switch unit stops outputting the first power voltage, the shorting unit connects the control terminal and the first terminal according to the first scan signal, and the input unit outputs the data voltage to the second terminal according to the first scan signal.

4. The pixel driver of claim 3, wherein, during a light-emitting period after the charging period, the power switch unit outputs the first power voltage, and the voltage-dividing unit adjusts the control voltage according to the second scan signal, such that the pixel-driving unit provides the driving current to the LED according to the voltage difference between the control terminal and the second terminal.

5. The pixel driver of claim 1, wherein the LED has a third terminal and a fourth terminal, the third terminal is configured for receiving the data voltage, the fourth terminal is configured for receiving a third power voltage, and a difference between the data voltage and the third power voltage is smaller than a threshold voltage of the LED.

6. The pixel driver of claim 1, wherein the input unit comprises a first transistor, and the first transistor comprises:

a gate terminal configured for receiving the first scan signal;

a first terminal configured for receiving the data signal; and a second terminal electrically connected to the second terminal of the pixel-driving unit and configured for transmitting the data voltage to the pixel-driving unit.

7. The pixel driver of claim 1, wherein the power-switching unit comprises a second transistor, and the second transistor comprises:

a gate terminal configured for receiving the power-controlling signal;

a first terminal configured for receiving the first power signal; and a second terminal electrically connected to the first terminal of the pixel-driving unit and configured for transmitting the first power voltage to the pixel-driving unit.

8. The pixel driver of claim 1, wherein the shorting unit comprises a third transistor, and the third transistor comprising:

a gate terminal configured for receiving the first scan signal;

a first terminal electrically connected to the first terminal of the pixel-driving unit; and a second terminal electrically connected to the control terminal of the pixel-driving unit.

9. The pixel driver of claim 1, wherein the pixel-driving unit comprises a fourth transistor, and the fourth transistor comprising:

a gate terminal electrically connected to the control terminal of the pixel-driving unit;

a first terminal electrically connected to the first terminal of the pixel-driving unit; and a second terminal electrically connected to the second terminal of the pixel-driving unit.

10. The pixel driver of claim 1, wherein the voltage-dividing unit comprises a first capacitor and a second capacitor, and the first capacitor comprises:

a first terminal electrically connected to the control terminal of the pixel-driving unit; and a second terminal configured for receiving the second scan signal, such that the second scan signal is coupled to the first terminal of the first capacitor through the first capacitor, and further that the voltage-dividing unit adjusts the control voltage according to the second scan signal;

the second capacitor comprises:

a first terminal electrically connected to the first terminal of the first capacitor; and a second terminal configured for receiving the first power voltage;

wherein the second scan signal is coupled to the control voltage according to a capacitance ratio between the first capacitor and the second capacitor.

11. The pixel driver of claim 1, wherein the pixel-driving unit is further configured for superposing a threshold voltage on the data voltage and storing a superposed result as the control voltage.

12. A display panel comprises:

a plurality of pixels, wherein each of the pixels comprise: a LED; and the pixel driver of claim 1; and a plurality of shift registers, wherein a corresponding one of the shift registers is configured for generating the first scan signal.

13. The display panel of claim 12, wherein the phase of the waveform of the first scan signal is opposite to the phase of the waveform of the second scan signal.

14. The display panel of claim 13 further comprises:

a power controlling signal generator configured for adjusting the power controlling signal according to the first scan signal and the second scan signal.

15. The display panel of claim 14, wherein the power controlling signal generator further comprises:

a first switch unit configured for conducting a clock signal according to the first scan signal to adjust the power controlling signal; and a second switch unit configured for conducting a constant voltage according to the second scan signal to adjust the power controlling signal.

16. A driving method of pixel drivers comprises:

providing the pixel driver of claim 1;

during a resetting period, the shorting unit connecting the control terminal and the first terminal according to the first scan signal so as to reset the control voltage with the first power voltage;

during a charging period after the resetting period, the power switch unit stopping outputting the first power voltage, and the shorting unit connecting the control terminal and the first terminal according to the first scan signal, such that the pixel-driving unit performing voltage compensation; and during a light-emitting period after the charging period, the power switch unit outputting the first power voltage according to the first power voltage and the power controlling signal, and the voltage-dividing unit adjusting the control voltage according to the second scan signal, such that the pixel-driving unit providing a driving current to the LED according to the voltage difference between the control terminal and the second terminal.

17. The driving method of claim 16, wherein the pixel-driving unit performing voltage compensation further comprises:

superposing a threshold voltage on the data voltage and storing a superposed result as the control voltage by the pixel-driving unit.

18. The driving method of claim 16, wherein during the resetting period, the driving method further comprises:

providing the first scan signal having a first voltage level to the input unit and the shorting unit; and providing the power controlling signal having the first voltage level to the power switch unit to reset the control voltage with the first power voltage.

19. The driving method of claim 18, wherein during the charging period, the driving method further comprises:

switching the power controlling signal from the first voltage level to a second voltage level to stop outputting the first power voltage, the input unit outputting the data voltage to the second terminal according to the first scan signal, such that the pixel-driving unit performing voltage compensation; and providing the second scan signal having the second voltage level to the voltage-dividing unit.

20. The driving method of claim 19, wherein during the light-emitting period, the driving method further comprises:

switching the power controlling signal from the second voltage level to the first voltage level to output the first power voltage;

switching the first scan signal from the first voltage level to the second voltage level to stop outputting the data voltage and disable the shorting operation of the shorting unit; and switching the second scan signal from the second voltage level to the first voltage level to adjust the control voltage so as to drive the LED.

* * * * *